United States Patent [19]

Hein, Jr.

[11] 4,340,171

[45] Jul. 20, 1982

[54] AIR DRIVEN CENTRIFUGE ADJUSTABLE ROTOR SEAT

[75] Inventor: George N. Hein, Jr., San Carlos, Calif.

[73] Assignee: Beckman Instruments, Inc., Fullerton, Calif.

[21] Appl. No.: 182,726

[22] Filed: Aug. 29, 1980

[51] Int. Cl.[3] ..... B04B 9/14

[52] U.S. Cl. ..... 233/23 R; 233/1 C; 233/23 A

[58] Field of Search ..... 233/23 R, 23 A, 1 C, 233/24, 1 R; 308/9; 310/10, 105

[56] References Cited

U.S. PATENT DOCUMENTS

| | | | |
|---|---|---|---|
| 2,106,609 | 1/1938 | Krauss | 210/71 |
| 2,213,107 | 8/1940 | McBain | 233/32 |
| 2,872,104 | 2/1959 | Cizinsky | 233/23 |
| 3,456,875 | 7/1969 | Hein | 233/24 |
| 3,958,753 | 5/1976 | Durland et al. | 233/23 |
| 4,046,317 | 9/1977 | Hein | 233/23 R |
| 4,078,719 | 3/1978 | Durland | 233/23 R |
| 4,098,457 | 7/1978 | Gropper | 233/23 R |

*Primary Examiner*—Robert W. Jenkins

*Attorney, Agent, or Firm*—R. J. Steinmeyer; F. L. Mehlhoff; William H. May

[57] ABSTRACT

A rotor seat which automatically adjusts its position with respect to the rotor in response to air flow levitation air entering between the rotor and the rotor seat. The central portion of the rotor seat which has a mating design with the design of the bottom of the rotor is free to move in a vertical direction toward or away from the rotor in response to the flow of air. The rotor seat maintains its optimum position relative to the rotor, allowing the rotor to decelerate in a stable manner.

9 Claims, 3 Drawing Figures

AIR DRIVEN CENTRIFUGE ADJUSTABLE ROTOR SEAT

BACKGROUND OF THE INVENTION

This invention relates to air driven centrifuges and, more particularly, is directed to a self adjusting rotor seat for use with an air driven centrifuge to provide stable movement of the rotor in all phases of operation of the rotor.

Reference is made to U.S. Pat. No. 4,046,317 which discloses a uniquely designed rotor seat and corresponding rotor which operate in conjunction with levitation air to provide the desired stability in the operation of the rotor especially during deceleration of the rotor. More specifically, the referenced patented invention utilizes the unique design of the rotor seat and the lower portion of the rotor to form a flow path for the levitation air, so that the movement of the air between the rotor and the rotor seat enhances the retention of the rotor within the rotor seat. Also, the particular configuration of the rotor and rotor seat aids in the maintenance of the proper alignment of the rotor with its rotational axis. At the critical or threshold speeds during deceleration the rotor must not experience any precessional or wobbling movement, because this detrimental movement would invalidate the centrifugation run or in extreme cases cause the rotor to escape the rotor seat and thrash around within the centrifuge housing. The levitation air with the design shown in U.S. Pat. No. 4,046,317 allows the rotor to smoothly decelerate and float on a friction free cushion of levitation air.

However, in order to provide the optimum design and configuration between the conforming surfaces of the rotor seat and the lower portion of the rotor, it is necessary that these particular portions of the centrifuge be manufactured with extremely close tolerances. The dimensions are very critical with respect to the operation of the air driven rotors at extremely high rotational speeds such as 150,000 r.p.m. to 200,000 r.p.m. If the design tolerances are not properly met in the construction of the centrifuge, improper rotation of the rotor may occur during these high speeds as well as the critical threshold speeds that occur not only during deceleration, but also during acceleration while the rotor is between its operating speed and its stationary position.

SUMMARY OF THE INVENTION

The present invention is an improved design over the reference U.S. Pat. No. 4,046,317 in that it allows for reduced critical tolerances in the construction of the rotor seat and rotor. The rotor seat is made to be self-adjusting to automatically locate itself at the optimum or proper position with respect to the rotor in response primarily to the flow of levitation air between the rotor seat and the rotor. Some self adjustment will also occur when the drive air is actuated.

The rotor seat is allowed to freely move in a vertical direction toward or away from the bottom of the rotor when drive air impinges on the rotor and when the levitation air is exiting through the center portion of the rotor seat. The Bernoulli effect or force which occurs between the rotor and the rotor seat creates an area of less dense air within the path between the rotor and rotor seat.

The movable rotor seat may continually self adjust primarily during the levitation stage of operation, so that the rotor seat is always in its proper position relative to the rotor throughout the rotor's deceleration.

Therefore, the critical tolerances that are typically required with respect to the rotor seat and the rotor are reduced by having the rotor seat automatically self-adjust to its proper position.

DETAILED DESCRIPTION OF THE INVENTION

Figure 1:
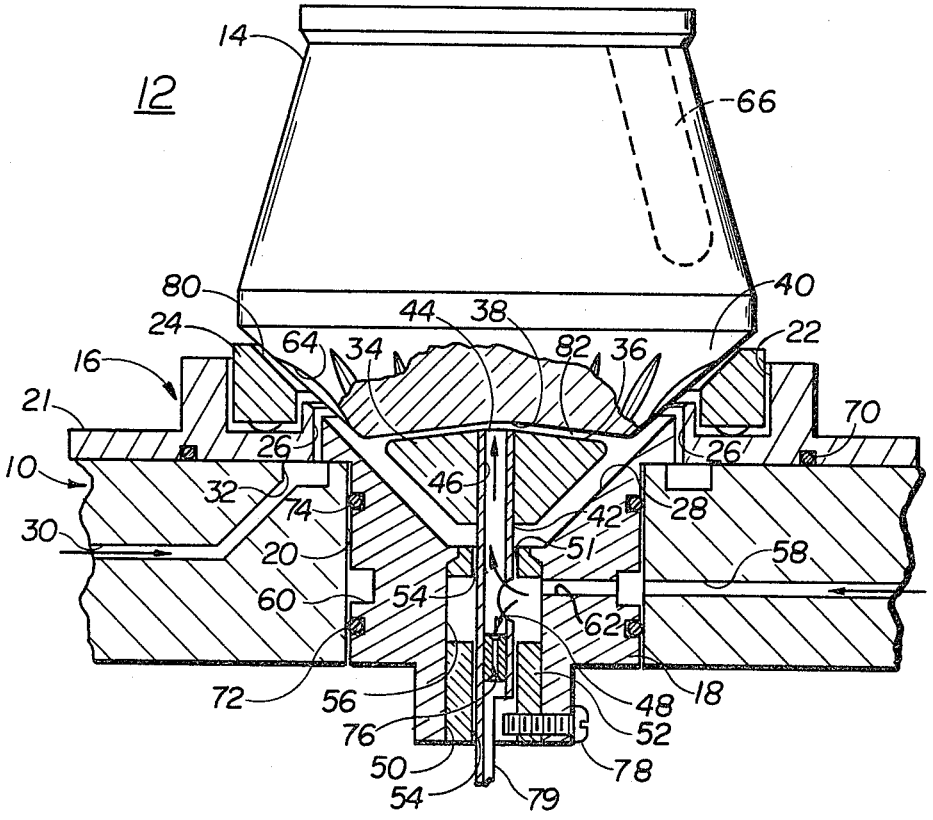
FIG. 1 is a sectional elevation view of the present invention.

Reference is made to FIG. 1 partially showing the bottom portion 10 of a rotor chamber 12 in which is situated a rotor 14. Secured to the bottom 10 of the rotor chamber 12 is a stator body 16 which has a central depending portion 18 that is received within the central aperture or opening 20 in the bottom 10 of the centrifuge housing. The outer flange portion 21 of the stator body 16 has a stator pad channel 22 which is designed to receive the stator pad 24. The operation of the stator pad 24 is discussed in more detail in U.S. Pat. No. 3,456,875. Located adjacent the stator pad 24 are a plurality of air drive jets 26 which are positioned in uniform annular spaced relation around the frustoconical recessed portion 28 of the stator body 16. As will be explained, drive air entering through the supply line 30 and into the annular chamber 32 is exerted through the drive jets 26 to rotate the rotor 14.

Positioned within the recessed conical area 28 of the stator body is the rotor seat 34. The upper surface 36 of the rotor seat has a slight projecting conical configuration which is designed to conform with the slight recessed conical surface 38 in the lower portions 40 of the rotor 14. The rotor seat 34 is connected to a support tube 42. Located in the upper surface 36 of the rotor seat 34 is a central port 44 which is in fluid communication with an interior passage 46 within the tube 42 and which extends into the depending central portion 18 of the stator body 16. The passage 46 establishes fluid communication between the port 44 in the rotor seat 34 and a side opening 48 in the tube 42 below the rotor seat 34. Mounted within a central opening 50 in the central depending portion 18 of the stator body 16 are sleeves 51 and 52 designed to slidably receive the tube 42. The interior dimension 54 of the sleeves 51 and 52 is slightly larger than the outer dimension of the post 42, so that the tube 42 is allowed to move in a vertical direction with respect to FIG. 1.

The side opening 48 in the tube 42 is designed to be located in an annular opening 56 which is between the sleeves 51 and 52. In fluid communication with the annular opening 56 is an air levitation supply line 58. Air enters through the supply line 58 and a manifold 60 for passage through one or more entry lines 62 into the annular opening 56. Levitation air entering the annular opening 56 will flow through the side opening 48 in the tube 42 and proceed toward the port 44 in the upper surface of the rotor seat 34 for flow between the rotor seat 34 and the rotor 14 in the manner described and explained in the reference U.S. Pat. No. 4,046,317.

The lower portion 40 of the rotor has a plurality of flutes 64 which are designed to receive the drive air from the drive jets 26 to cause the rotor to rotate at very high speeds. The rotor 14 is designed to carry a plurality of relatively small centrifuge tubes 66, one of which is shown in phantom. In other circumstances, the rotor may be designed to carry a specifically designed rotor liner wherein there will be a central chamber and an outer annular chamber.

The stator body 16 is secured to the centrifuge housing bottom 10 by fastening means (not shown). An O-ring seal 70 is provided to prevent the escape of any drive air which may propagate along the interface between the bottom of the centrifuge housing and the stator housing 16. Also, the O-rings 72 and 74 are utilized in the depending central portion 18 of the stator body to seal the levitation air which is entering through the manifold 60.

Located in the tube 42 below the side opening 48 is an orifice 76 which is designed to vent the passage 46 to the atmosphere when the levitation air is not operating. Also, a screw 78 is located in the lower portion of the sleeve 52, so that the tube 42 and rotor seat 34 are kept from rotating because screw 78 extends into a cutaway portion 79 of tube 42. A set screw could be employed here to hold rotor seat 34 in a fixed position if desired.

Turning to the operation of the present invention, attention is directed to FIG. 1 where the rotor 14, containing a fluid mixture for centrifugation, is placed within the rotor chamber 12. The lower portion 40 of the rotor is positioned within the supporting area of the stator body 16. It should be noted, however, that sloping surface 80 of the stator pad 24 has a slightly steeper slope than that of the frustoconical portion 28 of the stator body 16. Consequently, the rotor 14, when it rests and nests within the stator body 16, bears primarily on the stator pad 24, and will come closely adjacent of the rotor seat 34.

The drive air supply line 30 provides air under pressure into the manifold or annular opening 32 for the entry of the air into the drive jets 26 that project air under pressure on the rotor flutes 64, causing the rotor 14 to rotate at very high speeds. During the flow of high speed air between the rotor and rotor seat, the freely movable rotor seat will tend to move up toward the rotor, because the air is less dense between the rotor and rotor seat. In fact, a slight vacuum may occur between the rotor and rotor seat, resulting in the possible contact between the rotor and rotor seat. However, the passage 46 is vented to atmosphere and, therefore, will allow the rotor seat to attain its proper position with air between it and the rotor.

As more clearly defined in the referenced U.S. Pat. No. 4,046,317, once the centrifugation operation has been completed, the drive air supply is curtailed and while the levitation air supply through the conduit 58 is activated to proceed into the passage 46. The valving arrangement is designed so that air flow is not exiting both the air levitation port 44 at the same time the air driving jets 26 are operating, because some instability may be introduced to the rotor. As the air under pressure exists the levitation air port 44 and proceeds along the conical flow path 82 between the rotor seat 34 and the rotor 14, it exits into the rotor chamber 12. Since no forcing air is impinging upon the rotor flutes 64, the rotor 14 is allowed to coast freely during deceleration. Because the air flowing from the levitation air opening 44 and along the conical flow path 82 at a significant velocity, the air pressure in the space between the rotor 14 and the rotor seat 34 is reduced to below atmospheric pressure and is less dense due to the Bernoulli principle that as air velocity increases, air pressure and density will tend to decrease. Hence, the atmospheric pressure surrounding the majority of the rotor 14 will hold the rotor stable and in proper alignment within the stator body 16 on the rotor seat 34.

In the rotor design as set forth in the reference U.S. Pat. No. 4,046,317, the tolerances required in the making of the fixed rotor central seat as well as the bottom conical portion of the rotor must be such that the rotor will ride down on the rotor seat with a desirable small separation between the two which may be as little as approximately 0.005 of an inch. In order to be assured that the rotor will ride in such close proximity to the rotor seat the tolerances on a fixed rotor seat, the stator, and stator pad as well as the rotor are extremely critical. The present invention allows for the vertical movement of the rotor seat 34 to eliminate the extreme criticality of the tolerances that are necessary in the making of the respective bottom portion of the rotor as well as the central conical rotor seat.

Therefore, as the levitation air enters into the passage 46 and exits through the levitation port 44, the velocity of air flow between the rotor seat and the rotor will, as described previously, result in somewhat reduced density and air pressure between the seat and the rotor. The rotor seat 34 will move slightly to its optimum position with respect to the rotor, so that the rotor will seat properly within the stator body adjacent to the rotor seat 34.

Figure 2:
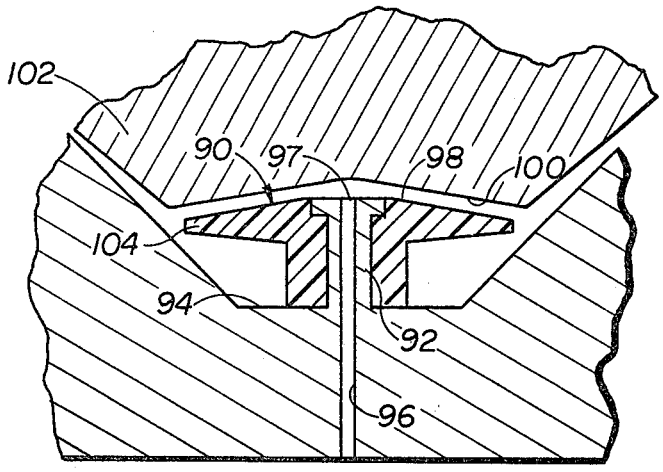
FIG. 2 is a sectional elevation view of an alternate embodiment of the present invention in a first position.
Figure 3:
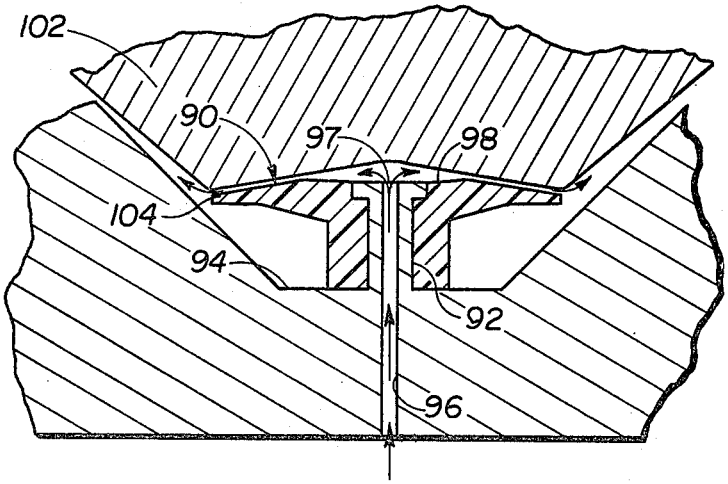
FIG. 3 is a sectional elevation view of the alternate embodiment of FIG. 2 in a second position.

An alternate embodiment of the present invention is shown in FIG. 2 wherein the rotor seat 90 is made of a flexible or movable type of material such as rubber and is secured to a protruding post 92 that extends upward from the bottom 94 of the stator body. Located in the center of the post 92 is the levitation air passage 96 which exits at the levitation air port 97. The conduit 96 may be vented to atmosphere when levitation air is off. The upper surface 98 of the rotor seat 90 is designed to be a slightly raised conical configuration to generally conform with the recessed conical shape 100 in the bottom of the rotor 102. As shown in FIG. 3, when the levitation air is operating, the lower pressure which occurs between the rotor seat 90 and the rotor 102 is such that the outer annular flange portion 104 of the rotor seat 90 will flex up into its proper position and clearance with respect to the rotor and provide a proper seat for the rotor to operate in a stable condition during deceleration.

It is envisioned that the embodiments of the present invention set forth herein could be structurally modified, but remain within the scope of the invention.

What is claimed is:

1. An air drive centrifuge apparatus comprising:

a housing;

a rotor chamber within said housing;

a rotor positioned in said rotor chamber;

a rotor seat for receipt of said rotor;

means for driving said rotor;

means for supplying supporting air to said rotor during deceleration when said driving means is not operating; and means responsive to said supporting air supply means for automatically and continually self-adjusting the position of said rotor seat relative to said rotor so that said rotor will decelerate in a stable manner.

2. An air drive centrifuge apparatus as defined in claim 1, wherein said positioning means comprises:

a support tube connected to said seat, said support tube preventing lateral movement of said seat, said seat having an opening, said tube having an internal passage in fluid communication with said opening; and an air source in fluid communication with said passage to provide levitation air between said central portion of said seat and said rotor, said support tube slidably mounted in the bottom of said rotor chamber.

3. An air drive centrifuge apparatus as defined in claim 2 and additionally comprising means for connecting said passage with atmospheric air.

4. An air drive centrifuge apparatus as defined in claim 1, wherein said positioning means comprises:

a post connected to said seat and supporting said seat above the bottom of said rotor chamber, said post having an air port and an internal passage in fluid communication with said port; and an outer annular portion on said seat extending beyone said support member to form an outer support flange, said annular portion being made of a flexible material, said passage in fluid communication with said supporting air means between said rotor and said seat, said outer annular portion of said seat moving in response to said supporting air to said optimum position.

5. A method of operating an air drive centrifuge apparatus having a rotor, a rotor seat for receipt of said rotor, drive air means in said seat to drive said rotor, and levitation air means in said seat to provide levitation support air to said rotor during operation, said method comprising the steps of:

placing said rotor on said rotor seat;

introducing drive air between said seat and said rotor to rotate said rotor;

shutting off said drive air after completion of the centrifuge run;

simultaneously introducing supporting air between said seat and said rotor to allow said rotor to decelerate in a stable manner; and simultaneously moving said seat relative to said rotor in response to said supporting air to establish the optimum position between said rotor and said seat for said stable rotor deceleration.

6. A method of operating an air drive centrifuge apparatus as defined in claim 5 and additionally comprising the step of securing said seat at said optimum position relative to said rotor.

7. An air drive centrifuge apparatus comprising:

a housing;

a rotor chamber within said housing;

a rotor positioned within said rotor chamber;

an adjustable rotor seat for receipt of said rotor;

means depending from said rotor seat for movably engaging the bottom of said chamber, said rotor seat movable with said engaging means, said rotor seat automatically movable in response to forces created between said seat and said rotor during centrifugation in order for said seat to automatically position itself at its correct tolerance location relative to said rotor so that said rotor will operate in a stable condition throughout the centrifugation run.

8. An air drive centrifuge apparatus comprising:

a housing having a rotor chamber;

a rotor positioned in said chamber;

a movable rotor seat for receipt of said rotor;

a support tube depending from said rotor seat and slidably mounted in said chamber; and air port means located in said seat for providing levitation air between said rotor and said seat to support said rotor during deceleration, said levitation air flowing between said seat and said rotor automatically adjusting said seat to its correct toleranced position relative to said rotor to enhance stable rotor operation.

9. An air drive centrifuge apparatus comprising:

a housing;

a rotor chamber within said housing;

a rotor positioned in said rotor chamber;

a rotor seat for receipt of said rotor;

means connected to said rotor seat for movably engaging said rotor seat within said chamber;

a first air supply means adjacent said rotor seat for driving said rotor; and a second air supply means in said rotor seat for providing levitation air between said seat and said rotor, said seat being movable in response to the forces created between said seat and said rotor by one of said first and second air supply means to automatically establish the proper clearance between said rotor and said portion of said seat to provide stable rotor operation.

* * * * *

UNITED STATES PATENT AND TRADEMARK OFFICE

CERTIFICATE OF CORRECTION

PATENT NO. : 4,340,171

DATED : July 20, 1982

INVENTOR(S) : George N. Hein, Jr.

It is certified that error appears in the above--identified patent and that said Letters Patent are hereby corrected as shown below:

Cover Sheet, Item [73] "Assignee: Beckman Instruments, Inc. Fullerton, Calif."

should be deleted in its entirety.

Signed and Sealed this

*Nineteenth* Day of *April 1983*

[SEAL]

*Attest:*

GERALD J. MOSSINGHOFF

*Attesting Officer*

*Commissioner of Patents and Trademarks*